US005226558A

United States Patent [19]

Whitney et al.

[11] Patent Number: 5,226,558

[45] Date of Patent: Jul. 13, 1993

[54] TRANSPORTABLE MULTI-USE STORAGE CONTAINER AND PALLET SYSTEM

[75] Inventors: Floyd A. Whitney, Riverside; Ronald E. Soderquist, Fullerton, both of Calif.

[73] Assignees: Rotonics Manufacturing, Inc., Garden; Western Poly Drum, Inc., Ontario, both of Calif.

[21] Appl. No.: 877,663

[22] Filed: May 1, 1992

[51] Int. Cl.[5] ..... B65D 23/00

[52] U.S. Cl. ..... 220/571; 220/630; 220/638; 206/386; 206/503

[58] Field of Search ..... 220/630, 638, 571; 206/386, 503

[56] References Cited

U.S. PATENT DOCUMENTS

| | | | |
|---|---|---|---|
| 2,620,089 | 12/1952 | Loghem | 220/630 |
| 3,471,114 | 10/1969 | Ball | 220/630 |
| 4,436,216 | 3/1984 | Chang | 220/630 |
| 4,609,120 | 9/1986 | Lauer et al. | 220/630 |
| 4,733,790 | 3/1988 | Stein | 220/630 |
| 4,742,931 | 5/1988 | Bennett | 220/630 |
| 5,029,734 | 7/1991 | Nichols | 206/386 |
| 5,052,582 | 10/1991 | Hall | 220/571 |
| 5,099,873 | 3/1992 | Sanchez | 220/571 |
| 5,105,947 | 4/1992 | Wise | 206/519 |

OTHER PUBLICATIONS

Poly Cal Plastics, Inc., advertising publication, pp. 14, 15 and product profile sheet with inset advertisement, Oct. 1985, publication title unknown.

Bonar Plastics Ltd., 32 page Product Catalog, Oct. 1988.

Poly Cal Plastics, Inc. 64 page Product Catalog for Zorb Tanks, Feb. 1, 1989.

*Primary Examiner*—Joseph Man-Fu Moy

*Attorney, Agent, or Firm*—Jacques M. Dulin

[57] ABSTRACT

A transportable, multi-use, non-corrodible, non-metallic, polyolefin plastic storage container and integral pallet system for all-weather storage, handling and transportation of a variety of liquid or free-flowing solid materials, including hazardous and human consumable materials. A preferred embodiment comprises a rotationally molded vertically-oriented polyethylene container, polyethylene container cushion with reinforcing wood base, and a cup-like polyethylene pallet which receives and is integrally attached by thermal shrinkage or welding to said container by locking and reinforcing ribs. The pallet includes integrally molded two-way access tunnels for handling by a fork lift or pallet jack. The container and integral pallet system can be stacked two or more containers high and is self-aligning when stacked. Additional features include a recessed manway and buttressed closure, recessed channels for a combination pressure and vacuum release valve, recessed off-set ballvalve with reinforced tunnel and sloping drain lip, an offset sump with bottom sloping to the sump for near 100% drainage without tipping, tie-down ears and wear pads on the pallet feet. The circumferential reinforcing and locking ribs prevent bowing of the container at its mid-point and the cup pallet provides double-walled protection for the container at the lower 25–75% of the container height. The container and integral pallet system complies with Department of Transportation ("DOT") regulations for exempt steel hazardous waste containers, and the material of which complies with the federal Food and Drug Administration ("FDA") regulations for storage and transportation of human consumable materials.

20 Claims, 2 Drawing Sheets

TRANSPORTABLE MULTI-USE STORAGE CONTAINER AND PALLET SYSTEM

FIELD

The invention relates to a transportable, drainable, multi-use storage container and pallet system which has a wide combination of special features for all-weather storage, handling and transportation of a variety of liquid or free-flowing solid materials, ranging from hazardous materials to food products. More particularly, the invention is directed to a rotationally molded multi-part, corrosion-resistant, polyolefin container and pallet system which can be easily handled by fork lift or pallet jack as a single integral unit, stacked two or more containers high, is self-aligning when stacked, and which complies with both the Department of Transportation ("DOT") regulations for exempt hazardous waste containers as well as the federal Food and Drug Administration ("FDA") regulations for storage and transportation of human consumable materials (food).

BACKGROUND

Rotationally molded plastic containers for the storage and transportation of hazardous and non-hazardous liquid and free-flowing solid materials have many advantages over traditional steel storage containers. They are light-weight, corrosion-resistant, less expensive to produce, can be translucent for content level observation or made of colored plastic for color-coded content identification purposes and can be molded into a number of seamless custom configurations for storage, handling and transportation.

However, rotationally molded plastic containers also have inherent limitations. A primary limitation is that the plastic container is flexible, distorting under load pressure, and is subject to cracking, rupture, and puncture requiring additional non-plastic protection means external to the container.

Manufacturers have attempted to overcome these inherent limitations by constructing variations of square, rectangular, spherical, or cylindrically shaped containers. Each of these different shapes trades the above stated limitations. That is, it may reduce some limitation, but, in turn, introduces its own inherent limitations.

For example, square or rectangular shapes have single-walled sharp edges requiring additional protection from pressure cracking and handling damage. Further, the bulkhead walls bow and distort under content pressure requiring additional lateral support. The bowing also changes the dimensions, causing problems for preconfigured storage and shipping. Manufacturers have attempted to overcome these limitations by integrally molding vertical support ribs, and/or placing steel protective support cages around these types of square or rectangular containers.

Round and cylindrical type containers also have inherent limitations of bulging and distortion of the wall of the container requiring a steel support cage or steel retaining strap (hoop). In addition, round containers and cylindrical containers laid on their side(s) require additional support and handling means such as a saddle pallet and additional external means for stacking the same or like containers.

The addition of steel supporting structures and strapping external to a plastic container vitiates the corrosion-resistant advantage of a plastic container. In addition, the external pallets have a tendency to move and twist free of the container when handled and transported.

As a result, manufacturers have resorted to a container-within-a-container concept with integrally attached pallet. For example, Bonar Plastics, Inc., of Ontario, Canada places a spherical plastic bottle container inside a square or cylindrical plastic support container with fitted cushions and integrally molded forklift tunnels. Plastic Products Manufacturing, Inc., of Fort Worth, Tex. makes a square plastic container inside a second protective square plastic container, and the two containers are thermally welded together to form a single integral unit which includes forklift access tunnels.

While the container-within-a-container concept helps to overcome some of the inherent limitations of the non-steel supported polyethylene container, they nearly double the cost of production over single containers, reduce the light-weight advantage of a single container, increase overall container assembly size or reduce capacity, and reduce or completely eliminate the content level observation feature of a translucent polyethylene container. In addition, the fully enclosed double container increases molding complexities resulting in the sacrifice or trade-off of integrally molded features such as for stacking of same or like containers, tie-down of the container during transportation, container top access to manways, and accessible recessed discharge valves.

Therefore, there is a need for a transportable, multi-use, non-corrosive, all polyolefin translucent plastic container and pallet system having a protected, strengthened, and cushioned single container with an integral, thermally attached pallet for handling and transportation, and having integrally molded features for stacking, tie-down, accessible manway, and near-100% draining of contents.

THE INVENTION

Objects

It is among the objects of this invention to provide a transportable multi-use storage container and pallet system which system is made entirely of noncorrosive materials comprising generally a rotationally molded polyolefin plastic storage container, a polyolefin container cushion with reinforcing wood base, and a polyolefin pallet.

It is another object of this invention to provide a transportable multi-use storage container and pallet system comprising a rotationally molded polyethylene plastic container and pallet system which container and pallet are integrally engaged by locking ribs and fused by a thermal process or shrink fit.

It is another object of this invention to provide a transportable multi-use storage container and pallet system comprising a rotationally molded polyolefin container and pallet, which pallet has special means for handling by forklift or pallet jack and means for stacking like palletized-containers in a specific aligned orientation.

It is another object of this invention to provide a multi-use transportable container storage and pallet system which can be easily manufactured in a variety of grades of polyolefin plastics, from cross-linked polyethylene grades for hazardous waste to F.D.A. approved grades for human consumable materials.

It is another object of the invention to provide a transportable multi-use cylindrical, fully drainable storage container and pallet system of noncorrosive, nonmetallic construction having a variety of advantages and features which is easy and inexpensive to manufacture and assemble.

Still other objects will be evident from the specification, drawings, and claims of this case.

DRAWINGS

The invention is illustrated in more detail by reference to the drawings in which.

SUMMARY

Figure 1:
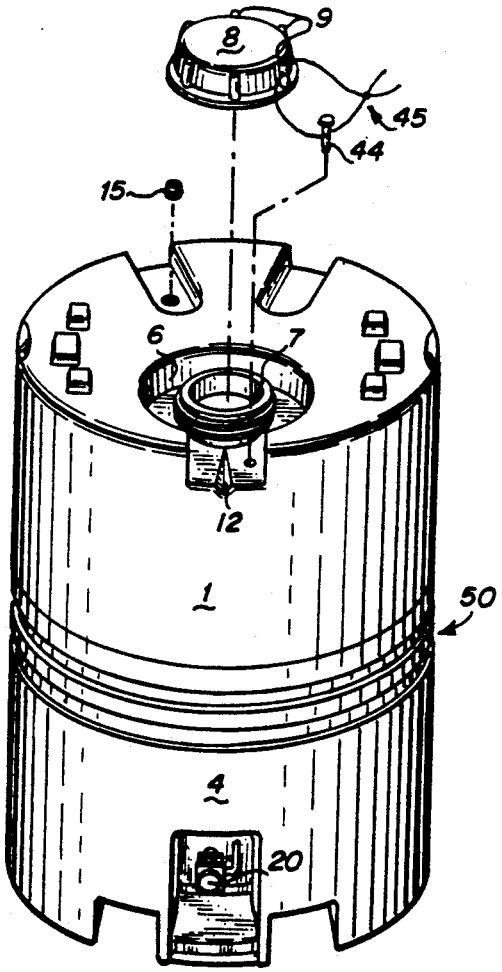
FIG. 1 is an isometric view of the assembled container and pallet system of this invention.

The invention is directed to a transportable multi-use storage container and pallet system constructed of nonmetallic, and therefore non-corrosive, rotationally molded polyolefin plastic, preferably polyethylene. The container and pallet system comprises a specially molded polyethylene cylindrical, vertically oriented axis drum-type container, a specially molded polyethylene container cushion with reinforcing wood base, and a specially molded polyethylene cylindrical cup-like pallet. Tee container and pallet are receivingly interengaged by specially molded corresponding horizontal locking ribs, which are sealed air and water-tight by a shrink fit and/or thermal welding process.

The container and pallet system of this invention has a wide variety of features both in construction and use, which in combination provide distinct advantages over existing steel containers, square plastic steel strapped or caged containers, or plastic containers within a second plastic container. A summary of the advantages of the invention are as follows:

Non-corrosive Construction Material

The invention is constructed of varying grades of polyolefin, preferably polyethylene, plastic, ranging from superior strength cross-linked polyethylene for the storage and transportation of hazardous materials, to FDA approved resins for the storage and transportation of human consumable materials.

The totally non-metallic construction of the polyethylene container and pallet system provides a durable non-corrosive container and pallet system for safe all weather use, storage, handling, and transportation of varying liquid and free-flowing solid materials. When the container and pallet system is made of cross-linked polyethylene, the container is exempt from the California D.O.T. regulations for steel containers for storage and transportation of hazardous wastes. When the container is made of FDA approved polyethylene resins, it can be used to store and transport human consumable materials.

Translucent and Colored Polyethylene

The use of translucent polyethylene plastic provides for content level observation without exterior site gauges. Likewise, the pallet can be made of different contrasting color polyethylene plastics such as red, blue, green, yellow, and black for color code identification of content, material manufacture or source, routing, required disposal (hazardous, non-hazardous, acutely hazardous, food grade, agricultural, animal feed grade), etc.

Unitary Assembly

An important feature of the transportable multi-use container and pallet system is its permanent unitary assembly. The container and pallet system is comprised primarily of three polyolefin plastic parts, a container, a container cushion with wood reinforcing base, and a pallet. To assemble the system, the container cushion with reinforcing wood base is aligned such that the step-downs of the container cushion and wood reinforcing base cut-out match the discharge ball valve cut-out of the pallet. The pallet alone is then placed into an annealing oven for a time and temperature (e.g., thirty minutes @200° F.) sufficient to cause the pallet polyolefin plastic to expand. The annealed (expanded) pallet is then removed from the oven and the container cushion with reinforcing wood base and container are inserted into the cup-like pallet before it has had an opportunity to cool. The container cushion and reinforcing wood base is fitted flush to the conforming bottom of the cup-like pallet. The container is aligned such that the sump conforms to the first step-down of the container cushion and is pressed downward to matingly engage the locking ribs and channels of the container and pallet. Upon cooling of the annealed pallet, the polyoelfin plastic shrinks to less than its originally molded dimension causing a shrink fit air and water tight seal between the locking ribs of the container and pallet. In an alternative embodiment, the locking ribs of the container and pallet are sealed by thermal ultra-sonic or plastic rod welding. The result is a reinforced, unitary container and pallet system which provides for superior storage, handling and transportation of materials in any type of weather condition.

An important feature of the unitary, sealed container and pallet system is that it prevents twisting or other undesirable movement between the container and the pallet found to occur during handling and transportation in existing container and exterior pallet systems.

Double Wall Strength and Protection

The raised outer cylindrical wall of the pallet can extend upwardly from the base of the container, e.g., from about 25% to about 75% of the height of the container, providing double-wall structural support and protective strength such as that found in the container-within-a-container concept but without the disadvantages. A preferred height is approximately 40%–60% of the height of the container providing for double-wall strength at or near the primary flex point of the side wall of the container when filled.

Likewise, the corresponding multiple horizontal locking ribs are integrally molded at the critical mid-point of the container to prevent outward bowing of the walls of the container. Square or round containers having single-walled integrally molded vertical reinforcement ribs or single-walled horizontal ribs do not share the same anti-bowing advantages as the double-walled horizontal locking ribs of this invention.

Stackability

Another important feature of the invention is that the container and pallet system is stackable in an aligned and fixed orientation. The top surface of the container has integrally molded raised, rectangular and somewhat tapered protrusions or "alignment keys" which matingly engage integrally molded "keyhole" or "pocket" recesses in the feet of the pallet of a second container/-pallet system stacked on top of a first container/pallet system. These alignment keys and recesses are arranged so that there is only "one-way" stacking. That is, the container and pallet system units can be multiply stacked in only one fixed orientation with a recessed discharge valve access tunnel pointing in one direction. Accordingly, there is a "front" and a "back" of the container and pallet system of this invention.

The alignment keys and corresponding recesses are tapered so that they tend to be self- aligning when stacked. That is, if slightly misaligned upon stacking, the pallet will rotate slightly into the proper aligned position. As a result, multiply stacked container and pallet systems cannot be misaligned. All of the discharge valve outlets are aligned in one fixed orientation for various purposes including safety in handling, discharge valve manipulation and inspection and maintenance.

Tie-down Ears

The top surface of the container also has at least two integrally molded raised protrusions or "tie-down ears" symmetrically located centrally of the front and back of the container, each on opposite sides of the perimeter edge from the other. These tie-down ears are provided as means for securing the container and pallet system by rope or cable looped thereover to a vehicle to prevent movement during transportation. No additional separate or special fittings are required for tie down during transportation.

Recessed Theft and Tamper Proof Lid and Drainable Well Area

The top of the container also has an integrally molded recessed well area with a raised, buttress threaded, manway (wide-mouth opening) for removably engaging a rotationally molded, screw-on, double wall plastic lid. Said screw on, double wall lid has integrally molded vertical external ribs for increased strength and a sealed wire means for theft and tamper-proofing. The container manway is positioned offset to the front center of the container so that it is positioned vertically directly over the bottom sump of the container. A portion of the top front of the container is recessed to provide a radial side access channel to the well area and manway permitting ease of manually engaging and disengaging the lid and locking means. The radial side access channel bottom slopes downwardly and outwardly from the well area and includes an integrally molded drain chime for draining casual liquid from the well area.

Recessed Pressure Relief and Vacuum Relief Valves

The top of the container also has two integrally molded recess slots for the recessed engagement of a pressure relief valve in one slot and a vacuum release valve in the other slot, or the engagement of at least one combination pressure and vacuum relief valve in either of the two recessed slots leaving one slot open for the optional engagement of another accessory if needed later.

Container Material Drainage

The container bottom is specially molded to have a substantially convex or otherwise circumferentially sloping surface toward an integrally molded sump positioned vertically directly below the manway. The front vertical wall of the sump forms the inner vertical wall of a recessed tunnel to which a discharge ball valve is attached off-center, e.g., approximately one inch left of center away from the side of the valve handle, giving additional room for valve handle manipulation. The recessed bottom-side walls of the container forming the access tunnel to the recessed discharge ball valve have integrally molded vertical ribs to prevent bowing of the walls under liquid head pressure and interference with manipulation of the discharge ball valve handle. Upon assembly of the container and pallet system, the recessed discharge ball valve is thus afforded four-sided protection from accidental damage during movement or transportation.

The bottom of the container rests on a container "cushion" which is a specially molded polyethylene support of generally circular, contoured shape having integrally molded parallel vertical support ribs. The top surfaces of the ribs conform to the slope of the bottom of the tank. The container cushion also has a step-down conforming to the shape of the container sump, and a second step-down with a downward sloping surface which extends outward and under the discharge ball valve of the tank and beyond the outer edge of the pallet to terminate in a down-turned lip to ensure complete runoff of any drips, cleaning liquids, rain, etc. The underside of the cushion is hollow and receives a mating sheet of reinforcing plywood, pressboard or the like, as a filler and tank contents weight spreading support. Thus, the sloping bottom of the container is fully supported such that there can be no weight-induced depressions or deformations in the bottom of the container which could prevent a complete drainage of the tank contents. Since the tank bottom is sloped, it does not need to be tipped in order to drain. Therefore, as a result of the combination of a fully cushion supported, sloping container bottom and sump, the container is nearly 100% drainable through the fully-protected, off-set discharge ball valve. Since the valve handle is free to move, due to ribs preventing bowing and the valve being off-set, the system of this invention is safer for workers to handle.

Handling Means

Another important feature of the container and pallet system is that the bottom of the pallet has integrally molded two-way access tunnels having sufficient dimensions for the use of both forklift and pallet jacks for handling. The access tunnels are positioned in parallel running front to back of the pallet, one tunnel on each side and below the discharge ball valve. Two-way entry from either the front or back of the pallet permits the forklift or pallet jack operator to properly position and align the container and pallet system units during handling and stacking.

The legs of the pallet have integrally molded wear ("scuff") pads on the bottom (floor surface contact) of approximately 15% greater wall thickness than the average wall thickness of the pallet. Each of the legs of the pallet also has at least one three-eighths inch hole in the bottom of the leg to permit the draining of any material that might enter the pallet, typically through condensation or seepage from an accidental break of the seal or puncture of the container. The leg drain holes also serve an important function in the detection of any accidental puncture or breakage of the container below the sealed locking ribs of the container and pallet. The container itself has an integrally molded overlapping shoulder which shields the upper edge of the pallet lip so that seepage through the shrink-fit locking ribs is very unlikely. In addition, a small gap between the pallet lip and container is filled with silicon or similar type caulking material as a redundant anti-seepage measure.

The triple base (comprising the molded undersurface of the container, the container cushion with wood reinforcing base and the pallet) affords heavy-duty protection against accidental punctures during handling such as by forklifts or other mishandling, etc.

DETAILED DESCRIPTION OF THE BEST MODE

The following detailed description illustrates the invention by way of example, not by way of limitation of the principles of the invention. This description will clearly enable one skilled in the art to make and use the invention, and describes several embodiments, adaptations, variations, alternatives and uses of the invention, including what we presently believe is the best mode of carrying out the invention.

Figure 2:
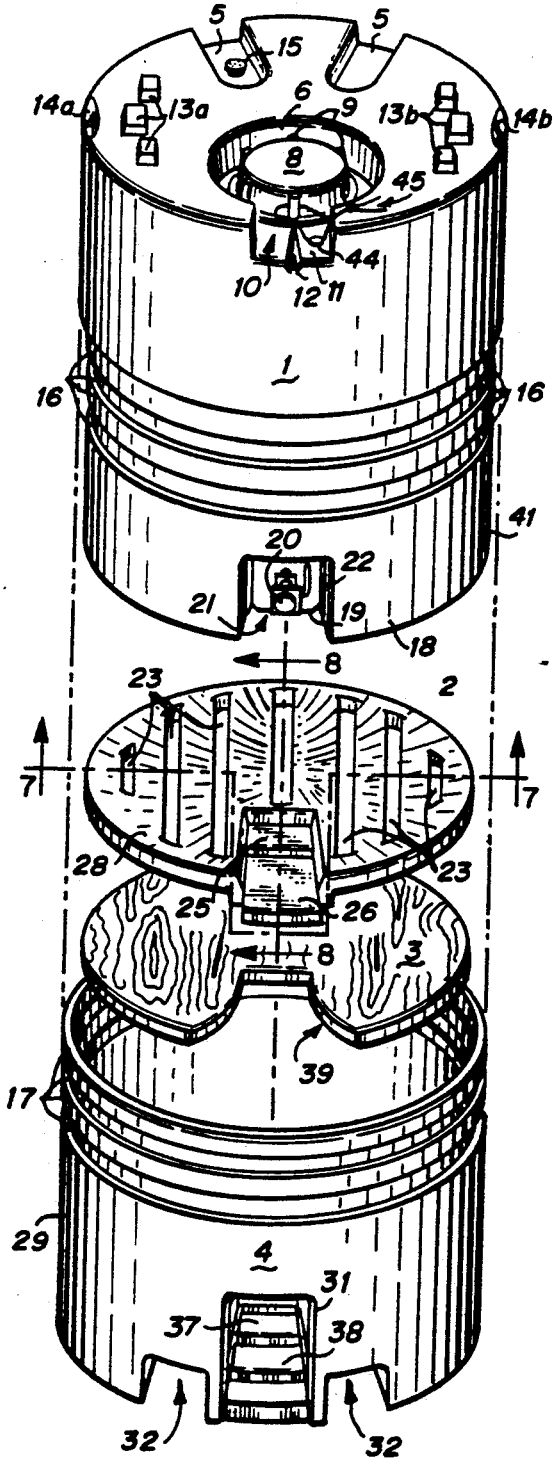
FIG. 2 is an exploded isometric view of the container and pallet system of this invention which shows the container, container cushion with reinforcing wood base, and pallet.

FIGS. 1 and 2 show the transportable multi-use container and pallet system 50 of this invention in an assembled (FIG. 1) and exploded view (FIG. 2). The transportable multi-use container and pallet system 50 comprises a container 1, a conforming container "cushion" 2 with reinforcing wood base 3, and a cup-like pallet 4. The container 1, container cushion 2, and pallet 4 are preferably made of rotationally molded polyethylene plastic. Cross-linked polyethylene plastic is preferred to meet DOT exemption requirements for the storage and transportation of hazardous materials. Thus, the container and pallet system can be used for storage and transportation of a variety of liquids and free-flowing solids including hazardous wastes. However, in an alternative embodiment, an FDA approved polyethylene resin is used to construct the container for storage and transportation of human consumable materials.

The container 1 of the system of the invention is preferably constructed of translucent polyethylene plastic for content level observation without the exterior use of sight gauges. In an alternative embodiment, the container 1 as well as the container cushion 2 and pallet 4 can be constructed of the same or differently colored polyethylene plastic such as red, blue, green, yellow, and black for purposes of color code identification of content, material manufacturer or source, routing, disposal protocol, etc.

Figure 6:
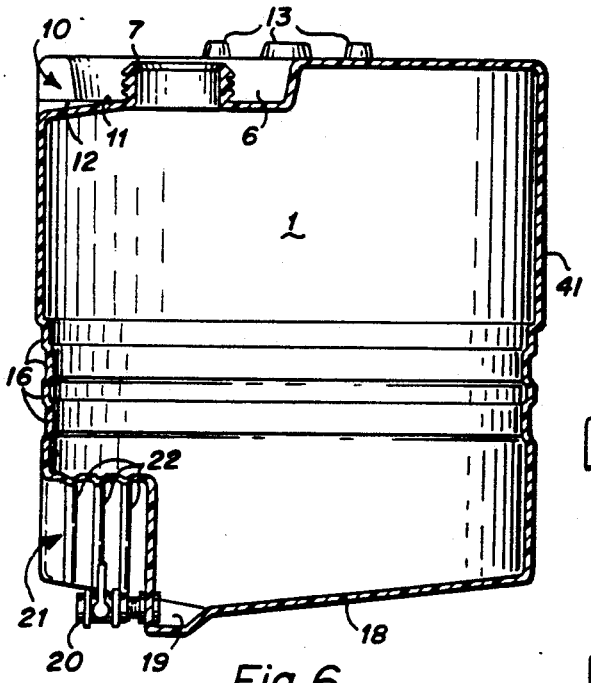
FIG. 6 is a cross-section of the container of this invention showing the raised, stacking orientation keys and tie down ears, the recessed top access channel to a well area and threaded manway, the horizontal locking ribs, the recessed bottom-side ribbed walls forming an access tunnel to a discharge ball valve attached to the vertical side-wall of a sump, and a sloping container bottom.

Referring now to FIGS. 2 and 6, the container 1 of the system 50 of the invention is rotationally molded in a generally cylindrical shape with a vertically oriented longitudinal axis. By way of example, the figures show a preferred container of size having a capacity sufficient to hold approximately 330 gallons of liquid, and having integrally molded special features including:

(a) Two symmetrical elongated radial channel recesses 5, one each positioned slightly left and right of center, in the top rear of the container I for the recessed attachment of a combination pressure and vacuum release valve 15, and/or for the attachment of other optional accessories such as an exterior content level sight gauge (not shown) used for opaque-colored polyethylene containers, or an electrical or manual pump (not shown), etc. A typical combination pressure and vacuum release valve is presently available from Western Poly Drum, Inc., of Ontario, Calif.

Figure 9:
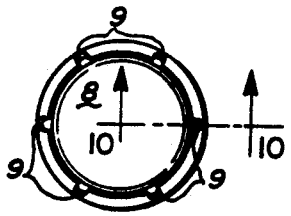
FIG. 9 is a plan view of the lid of the container of this invention.
Figure 10:
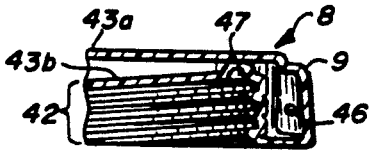
FIG. 10 is a partial cross-section view of the lid of the containter of this invention taken along the lines and looking in the direction of arrows 10—10 of FIG. 9.

(b) A recessed well area 6 having a raised, buttress threaded, wide-mouth manway 7 (See FIG. 1) for the fitting of a screw-on lid 8 (See FIGS. 9 and 10). The recessed well area 6 has an integrally-molded recessed top-front channel accessway 10 with a downwardly and outwardly sloping surface 11 and an integrally molded drain chime 12 for the complete draining of casual liquid from the well area 6 and accessway 10. The channel accessway 10 includes a drilled and tapped hole for removably engaging a bolt 44 through which is passed a sealable wire 45 for locking the lid 8 to the container 1;

(c) Multiple tapered protrusions or "stacking alignment keys" 13*a, b* used for "one-way" orientation, alignment, and stacking of multiple container and pallet system units;

(d) Multiple, raised "tie-down ears" 14*a, b* positioned on the outermost left and right perimeter edges to provide means (snub) for securing the container and pallet system unit by rope or cable, e.g., to a vehicle during transportation, the tie-down ears having a convex inner wall to prevent friction point wear o the ears or the tie-down line;

(e) A container wall 41 having integrally molded horizontal locking and reinforcing ribs 16 which matingly engage the corresponding integrally molded horizontal locking and reinforcing ribs 17 of the pallet 4;

(f) The bottom 18 of the container 1 (see FIG. 6) slopes downwardly from the exterior perimeter toward the sump 19 to which is attached a discharge ball valve 20. The valve is positioned off-center, e.g., one-inch left of center of the front vertical sump wall, for greater valve handle clearance and manipulation; and (g) A recessed three sided, rectangular, tunnel accessway 21 to the recessed discharge ball valve 20. Each of the three sides of the tunnel accessway has vertical ribs 22 (see FIG. 6) to prevent bowing of the container 1 bulkhead surrounding the discharge ball valve 20, thus preventing wall interference with the manipulation of the handle of the valve.

Figure 7:
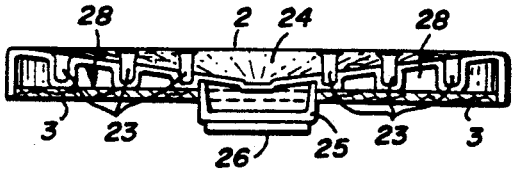
FIG. 7 is a horizontal partial cross-section view of the container cushion and reinforcing wood base of this invention taken along the line and looking in the direction of arrows 7—7 of FIG. 2.
Figure 8:
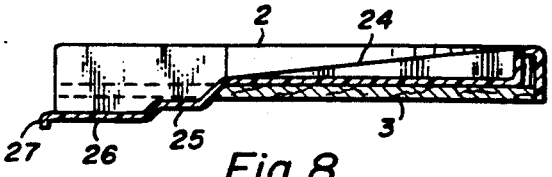
FIG. 8 is a horizontal cross-section view of the container cushion and reinforcing wood base of this invention taken along the line and looking in the direction of arrows 8—8 of FIG. 2.

Referring now to FIGS. 2, 7 and 8, the circular container cushion 2 of the system 50 of the invention is rotationally molded in a generally disc-like or pancake shape having integrally molded special features including:

(a) Multiple parallel, vertical support ribs 23 for vertical load strength;

(b) A sloping upper surface 24 which conforms to the shape of the bottom of the container 1 of the system of the invention;

(c) A first step-down 25 which conforms to the shape of the container sump 19;

(d) A second slightly downward and forward sloping step-down 26 which forms the bottom of the discharge ball valve access tunnel 21. The step-down terminates in a lip 27 which extends over the perimeter edge of the pallet 4 when assembled, for drainage of liquid from the discharge ball valve access tunnel 21; and (e) A hollow bottom area 28 which receives the cushion-reinforcing wood base 3. The wood base has a wide flared notch-like cut-out 39, which leads in from the perimeter and corresponds to the dimensions of the cushion's first and second step-downs to provide clearance for said step-downs.

Figure 5:
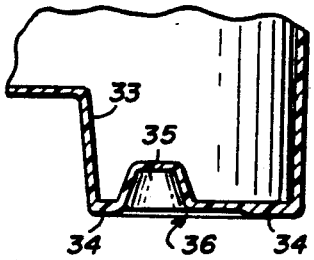
FIG. 5 is a detailed cross-section view of a leg, stacking orientation recess, and wear pad of the pallet of this invention taken along the line and looking in the direction of arrows 5—5 of FIG. 3.

Referring now to FIGS. 2, 3, 4 and 5, the pallet 4 of the system of the invention is preferably rotationally molded in a generally cup-like shape and has integrally molded special features including:

(a) A raised vertical cylindrical wall 29 which extends upwardly above the bottom 18 of the container 1, to a preferred height of 40% to 60% of the height of the container 1 to provide ribbed, double-wall structural strength which prevents outward bowing deformation of the container 1 at or near the primary flex point 30 of the side wall of the container 1 when filled (see FIG. 4), and to provide double-walled protective strength against rupture or accidental puncture of the container 1;

(b) Multiple horizontal locking and strengthening ribs 17 corresponding to the horizontal locking/strengthening ribs 16 of the container 1, which ribs are positioned about the critical mid-point 30 of the container to provide ribbed, double-wall strength preventing the outward bowing of the walls of the container when filled;

(c) A lower front rectangular cut-out portion 31, which corresponds in dimension to the discharge ball valve access tunnel 21 and which cut out forms the entrance to the access tunnel;

(d) A bottom 40 having parallel, front to back, two-way access tunnels 32 of sufficient dimension such that both a forklift and pallet jack can be used to handle and transport the container and pallet system 50 as a unitary device as shown in FIG. 1;

(e) A bottom 40 having multiple feet 33 with extra thickness wear pads 34, e.g., 10–50% (preferably about 15%) greater wall thickness than the overall average wall thickness of the pallet 4. The four pallet feet positioned on the left and right sides also have slightly tapered recesses or stacking "keyholes" 35 of shape and dimension corresponding to the container alignment keys 13 for multiple stacking of like container and pallet systems. These four corner feet and the center rear foot also have slight recesses 36 to prevent water planing on wet surfaces. Each of these features of a typical pallet foot 33: the wear pad 34, keyhole recess 35 and water displacement recess 36, are shown in FIG. 5 in exploded partial cross-section detail along the line and looking in the direction of arrows 4—4 of FIG. 3; and (f) A bottom 40 having a recessed first support step 37 and a recessed second support step 38, these support steps conforming to the shape and dimensions of the first and second step-downs 25 and 26 of the container cushion 2.

The container and pallet system 50 of the invention is assembled into a single, unitary system unit in the following steps (in progression from FIG. 2 to FIG. 1):

First, the container cushion 2 with reinforcing wood base 3 is assembled. This is accomplished by aligning the first and second step-downs 25 and 26 of the container cushion with the cut out of the wood reinforcing base 2, then inserting the wood reinforcing base 2 inside the hollow bottom 28 of the container cushion 2 such that it rests flush with the underside surface of the container cushion 2.

Second, the pallet 4 alone is inserted into an annealing oven (not shown) for approximately thirty (30) minutes at a temperature of 200° causing the polyolefin plastic of the pallet 4 to expand beyond its molded dimensions. After heating, the pallet 4 is removed from the oven.

Third, the container cushion 2 with its reinforcing wood base 3 as assembled in step one above is inserted into the pallet 4 as annealed in step two above. This is accomplished by aligning the first and second step-downs 25 and 26 of the container cushion 2 with the corresponding pallet discharge ball valve cut-out 19 and first and second support steps 37 and 38. Once aligned as depicted in FIG. 2, the container cushion 2 with its base 3 is then inserted downwardly in and pressed flush to the conforming bottom 40 of the pallet 4. When properly inserted, the container cushion lip 27 extends through and over the bottom edge of the pallet discharge ball valve cut-out 19.

Figure 3:
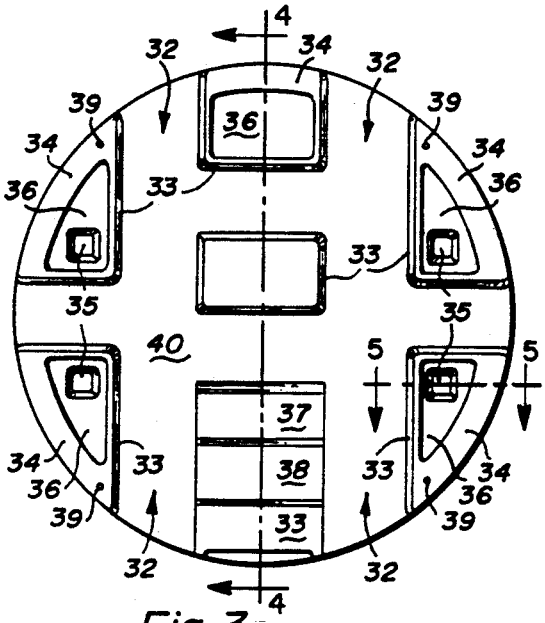
FIG. 3 is a plan view of the bottom of the pallet of this invention showing the forklift and pallet jack two-way (front/back) access tunnels and legs with wear pads and stacking orientation recesses.
Figure 4:
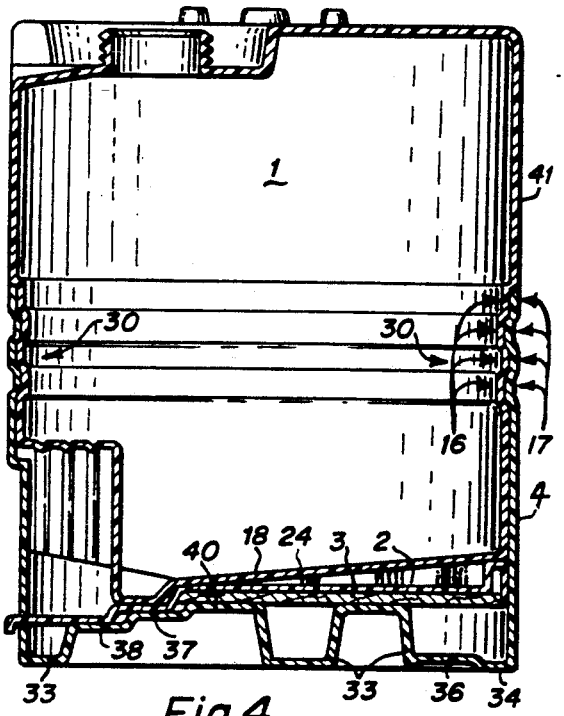
FIG. 4 is a vertical cross-section view of the assembled container and pallet system of this invention taken along the line and looking in the direction of arrows 4—4 of FIG. 3.

Fourth, the pallet 4 as assembled in step three described above is then mated with the container I. This is accomplished by aligning the container 1 with the pallet 4 so that the container sump 19 corresponds to the first step-down 25 of the container cushion 2. The container I is then inserted into the cup-like pallet 4 and is pressed downward to matingly engage the locking ribs of the container 16 with the locking ribs of the pallet 17. FIG. 4 is a horizontal cross-section view of the assembled container and pallet system of this invention taken along the line and looking in the direction of arrows 4—4 of FIG. 3 showing the proper alignment and assembled positions of the container 1, container cushion 2, container cushion wood reinforcing base 3, and pallet 4.

Steps three and four above are accomplished and completed before the pallet 4 as annealed in step two above has cooled. Upon cooling of the annealed pallet 4, the polyolefin shrinks causing a permanent shrink fit friction seal, air and water tight, between the locking ribs of the container 16 and the locking ribs of the pallet 17.

In an alternate embodiment, the container locking ribs of the container 16 and pallet 17 are sealed by ultrasonic or plastic rod welding.

As an alternative fifth step, holes are drilled and tapped for the attachment of fixtures such as the combination pressure relief and vacuum valve 15 and the discharge ball valve 20. In addition, the three-eighths inch drain holes 39 are drilled in the legs 33 of the pallet 4, if not earlier molded in or cut in prior to assembly.

Referring now to FIGS. 9 and 10: FIG. 9 is a plan view of the lid 8 (See FIGS. 1 (lid shown detached from container) and 2 (lid fitted to container)); and FIG. 10 is a partial cross-section view along the lines and looking in the direction of arrows 10—10 of FIG. 9. The lid 8 is preferably constructed of rotationally molded polyethylene plastic having butress threads 42, a double wall 43*a, b,* an integrally molded inner channel 47 for the placement of a gasket and integrally-molded, multiple, vertical, reinforcing ribs 9 with at least one rib having a drilled through hole 46 for the passing through of a sealable wire 45 (See FIG. 2). The reinforcing ribs 9 also function as hand holds for removably engaging the lid 8 to the manway 7. When the lid 8 is fitted (screwed-on) to the manway 7 as shown in FIG. 2, the top surface of the lid 8 is flush or preferrably slightly below the top level of the surface of the container 1.

The completely assembled container and pallet system as shown in the Figs. is a reinforced, transportable, multi-use unitary container and pallet system which provides for superior storage, handling and transportation of a variety of materials including hazardous waste and human consumables in any type of weather condition.

It should be understood that various modifications within the scope of this invention can be made by one of ordinary skill in the art without departing from the spirit thereof. We therefore wish our invention to be defined by the scope of the appended claims in view of the specification as broadly as the prior art will permit.

I claim:

1. A transportable, multi-use, non-corrodible, non-metallic, drainable plastic container and pallet system for storage and transportation of liquid or free-flowing solid materials comprising in operative combination:

a) a molded plastic storage container of generally cylindrical shape having at least one integral molded horizontal locking groove positioned in said side wall medially between said top and said bottom;

b) a molded plastic support cushion assembly, upon which said container rests, of generally circular disc-like shape comprising a planar top and a depending circumferential side wall;

c) a molded plastic pallet of generally cup-like shape having an integral molded bottom and a raised circumferential cylindrical side wall, said side wall including at least one integral horizontal locking and reinforcing rib; and d) said container and support cushion assembly being receivingly engageable into said pallet so that said container groove lockingly engages said pallet rib and said support cushion assembly is received within said pallet side walls and is supported by said pallet integral molded bottom.

2. A container and pallet system as in claim 1 wherein:

a) said molded plastic storage container of generally cylindrical shape includes a top, a sloping bottom with an off-center sump, and a cylindrical side wall;

b) said molded plastic support cushion assembly, upon which said container rests, includes:

i) integral support ribs for structural strength;

ii) a hollow bottom formed between said side wall and said top for receiving a reinforcing base member; and iii) said top which conforms to the sloping bottom of said container.

3. A container and pallet system as in claim 2 wherein:

a) said pallet bottom includes integrally molded legs spaced to provide tunnels for two-way handling by forklift or pallet jack.

4. A container and pallet system as in claim 3 wherein:

a) said container includes an integral recessed area in the side wall of said container adjacent its juncture with said bottom for the attachment of a means for draining said container.

5. A container and pallet system as in claim 4 wherein:

a) said container, container cushion, and pallet plastic is selected from rotationally moldable cross-linked polyethylene plastic, and suitable for storage and transportation of various corrosive and non-corrosive liquid or solid materials, including hazardous materials.

6. A container and pallet system as in claim 1 wherein:

a) said container and pallet system plastic is rotationally moldable and selected from the group comprising polyolefin plastics suitable for the storage and transportation of hazardous materials, a polyolefin resin suitable for the storage and transportation of human consumable materials, and combinations thereof.

7. A container and pallet system as in claim 4 wherein:

a) said container plastic is a translucent polyolefin plastic for content level observation without level sight gauges.

8. A container and pallet system as in claim 4 wherein:

a) at least one said container and pallet plastic is selected from a colored polyolefin plastic for color code identification of content, material manufacture or source, routing, or content disposal protocol.

9. A transportable, multi-use, noncorrosive, non-metallic container and pallet system as in claim 4 wherein:

a) said top of said container includes an integral recessed well area having a sloping recessed side access channel with integral drain chime for drainage of casual water;

b) said access channel and chime extending radially inwardly from the outer periphery of said top;

c) said well area includes a raised, buttress-threaded manway disposed vertically above said sump, to which manway may be removably attached a screw-on lid; and d) said lid having an outer wall, an inner wall, said inner wall having butress threads and an inner channel for the fitting of a gasket, said outer wall having multiple, vertical, reinforcing ribs and said ribs having at least one drilled through hole for the attachment of a sealable wire for locking said lid to said container.

10. A container and pallet system as in claim 9 wherein:

a) said top of said container includes at least one integral recessed radial slot of width sufficient to permit the attachment of a combination pressure and vacuum release valve plus other optional accessories such as a pump or content level sight gauge.

11. A container and pallet system as in claim 4 wherein:

a) said top of said container includes integrally molded means for securing said container and pallet system to a vehicle to prevent movement during transportation.

12. A container and pallet system as in claim 4 wherein:

a) said container top and pallet bottom includes cooperating, matingly engageable integrally molded keys and recesses for self-aligning, one-way stacking of one container and pallet system on top of another.

13. A container and pallet system as in claim 4 wherein:

a) said container side wall recess includes multiple vertical ribs to reduce bowing of said recess walls to limit interference with access and manipulation of said means for draining said container.

14. A container and pallet system as in claim 12 wherein said means for draining said container is a discharge ball valve mounted off-center in said recess so that there is more clearance for a lever handle of said valve.

15. A container and pallet system as in claim 13 wherein:

a) said legs include wear pads and at least one shallow recess for the displacement of water to prevent hydroplaning on wet surfaces.

16. A container and pallet system as in claim 14 wherein:

a) said legs include holes to permit detection and draining of liquids or solids finding their way into said legs through an accidental break in said locking ribs or through accidental punctures in said container or pallet side wall or bottom.

17. A container and pallet system as in claim 1 wherein:

a) said pallet and container matingly engaging rib and groove are sealed.

18. A container and pallet system as in claim 17 wherein:

a) said sealing is by thermal heating and cooling shrink-fit.

19. A container and pallet system as in claim 17 wherein:

a) said sealing is by ultra-sonic or plastic rod welding.

20. A container and pallet system as in claim 11 wherein:

a) said container and pallet system plastic is rotationally moldable and selected from the group consisting essentially of:

i) cross-linked, polyethylene plastic rotationally moldable, and suitable for storage and transportation of various corrosive and non-corrosive liquid or solid materials, including hazardous materials;

ii) plastic which meets the exemption, requirements of the Federal and State of California regulations for steel containers for the storage and transportation of hazardous materials;

iii) polyethylene resin approved by the Food and Drug Administration for the storage and transportation of human consumable materials;

iv) translucent polyethylene plastic for content level observation without level sight gauges;

v) colored polyethylene plastic for color code identification of content, material manufacture or source, routing, or content disposal protocol;

vi) combinations thereof;

b) said top of said container includes integrally molded means for securing said container and pallet system to a vehicle to prevent movement during transportation;

c) said container side wall recess includes multiple vertical ribs to reduce bowing of said recess walls to limit interference with access and manipulation of said means for draining said container;

d) said means for draining said container is a discharge ball valve mounted off-center in said recess so that there is more clearance for a lever handle of said valve;

e) said legs include wear pads and at least one shallow recess for the displacement of water to prevent hydroplaning on wet surfaces;

f) said legs include holes to permit detection and draining of liquids or solids finding their way into said legs through an accidental break in said locking ribs or through accidental punctures in said container or pallet side wall or bottom; and g) said pallet and container matingly engaging rib and groove are sealed.

* * * * *